US005941726A

United States Patent [19]

Koegel et al.

[11] Patent Number: 5,941,726

[45] Date of Patent: Aug. 24, 1999

[54] INTERLOCKING RELEASE LATCHING SYSTEM FOR ELECTRICAL CONNECTOR

[75] Inventors: Keith Scott Koegel, Plainfield; George Richard Defibaugh, Mechancisburg, both of Pa.

[73] Assignee: The Whitaker Corporation, Wilmington, Del.

[21] Appl. No.: 08/956,230

[22] Filed: Oct. 22, 1997

Related U.S. Application Data

[60] Provisional application No. 60/032,772, Nov. 27, 1996.

[51] Int. Cl.[6] ..... H01R 13/62

[52] U.S. Cl. ..... 439/358; 439/354

[58] Field of Search ..... 439/350–358

[56] References Cited

U.S. PATENT DOCUMENTS

| | | | |
|---|---|---|---|
| 4,367,003 | 1/1983 | Frantz | 339/91 R |
| 4,568,135 | 2/1986 | Frantz | 339/91 R |
| 4,961,711 | 10/1990 | Fujiura et al. | 439/357 |
| 5,167,523 | 12/1992 | Crimmins et al. | 439/350 |
| 5,383,794 | 1/1995 | Davis et al. | 439/352 |
| 5,486,117 | 1/1996 | Chang | 439/357 |
| 5,494,452 | 2/1996 | Matsumoto et al. | 439/358 |
| 5,588,864 | 12/1996 | Lin | 439/357 |

OTHER PUBLICATIONS

International Search Report mailed Mar. 4, 1998 in corresponding application PCT/US97/20885; two pages.

*Primary Examiner*—Hien Vu
*Attorney, Agent, or Firm*—Anton Ness

[57] ABSTRACT

Connector (10) including a connector subassembly (20) with a pair of covers (16) secured thereover extending from a mating face (24) to a cable exit to define a strain relief section (36) extending along a portion of cable (12). A pair of latch members (60) is secured in the connector, each in a respective channel (22) defined in the covers along opposite sides of subassembly (20). Actuating sections (68) protrude rearwardly along strain relief section (36) and are deflectable theretoward during actuation to release latching sections (64) from a mating connector for unmating. Protuberances (72) of the actuating sections 68 are received into recesses (40) of the strain relief section (36), for transmitting rearwardly directed unmating force from the latch members (60) to the strain relief section of the covers (16).

5 Claims, 3 Drawing Sheets

INTERLOCKING RELEASE LATCHING SYSTEM FOR ELECTRICAL CONNECTOR

This application claims benefit of provisional application 60/032,772, filed Nov. 27, 1996.

FIELD OF THE INVENTION

This relates to the field of electrical connectors and more particularly to systems for latching together mated pairs of connectors.

BACKGROUND OF THE INVENTION

Some electrical connectors terminatable to a cable include shields around an insulative insert containing an array of terminals for mating with another connector, and insulative covers are affixed therearound, such as is disclosed in U.S. Pat. No. 5,167,523. Latch members are disposed within the insulative covers to extend from latching sections along the mating face, rearwardly to actuating sections protruding rearwardly from the connector assembly that are manually deflectable toward each other and the cable therebetween to delatch the latching sections from corresponding latching sections of the mating connector for unmating, whereafter rearwardly directed unmating force is then applied to move the connector assembly rearwardly away from the mating connector.

It is desired to provide for long in-service life with multiple mating/unmating cycles of the connector assembly by reducing stress on the latch members and on the retention system defined by the connector for retaining the latch members in the assembly.

SUMMARY OF THE INVENTION

The present invention provides latch members disposed within an insulative cover of a connector that include actuating sections protruding rearwardly alongside a section of the cover that cooperates with the actuating sections upon full actuation to transmit rearwardly directed unmating force applied to the actuating sections, to the section of the cover to relieve stressing the retention of the latch members within the assembly.

Inwardly facing surfaces of the actuating sections include one or more protuberances that are received into recesses of the cover section upon full deflection of the actuating sections against the cover section.

An embodiment of the present invention will now be disclosed by way of example with reference to the accompanying drawings.

BRIEF DESCRIPTION OF THE INVENTION

DETAILED DESCRIPTION

Figure 1:
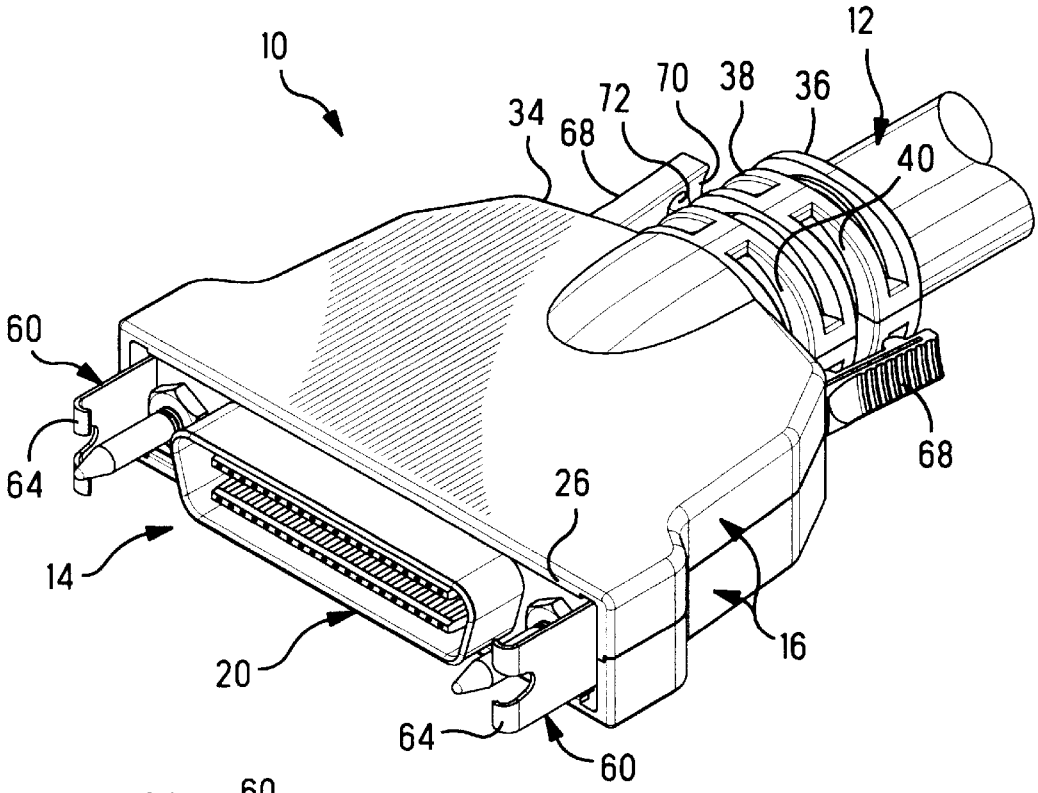
FIG. 1 is an isometric front view of an electrical connector containing the present invention.

Connector 10 is of the type terminated to a cable 12 containing a plurality of electrical conductors and matable to a complementary connector (not shown) at a mating face 14. The connectors are adapted to be latched to secure them together in their mated condition. Connector subassembly 20 includes front section defining mating face 14 and also has a rear section defining a rear face. A pair of latching members 60 are protected within upper and lower insulative covers 16, secured along opposed sides of connector subassembly 20 and extending along latch channels 22 from mating face 14 to rearwardly of cable exit 24.

Each latching member 60 includes a stiffly resilient body 62 having a latch section 64, a biasing section 66 along body 62, and an actuating section 68 at a rearward end. Upon being disposed in a channel 22 alongside subassembly 20, latch section 64 will extend forwardly from front end 26 of covers 16 and forwardly beyond mating face 14 of subassembly 20. Along channel 22, a tab 28 extends laterally outwardly from the side of the shield of connector subassembly 20 defining a fulcrum 28 spaced rearwardly from front ends 26. Near rear ends 34 of covers 16, a biasing section 66 is engageable with a side surface 30 of connector subassembly 20. Actuating section 68 protrudes rearwardly from openings 32 along cover rear ends 34 to coextend to free ends alongside rear section or strain relief portions 36 of covers 16 extending along a jacketed portion of cable 12 exiting from the rear face of the connector subassembly.

Figure 2:
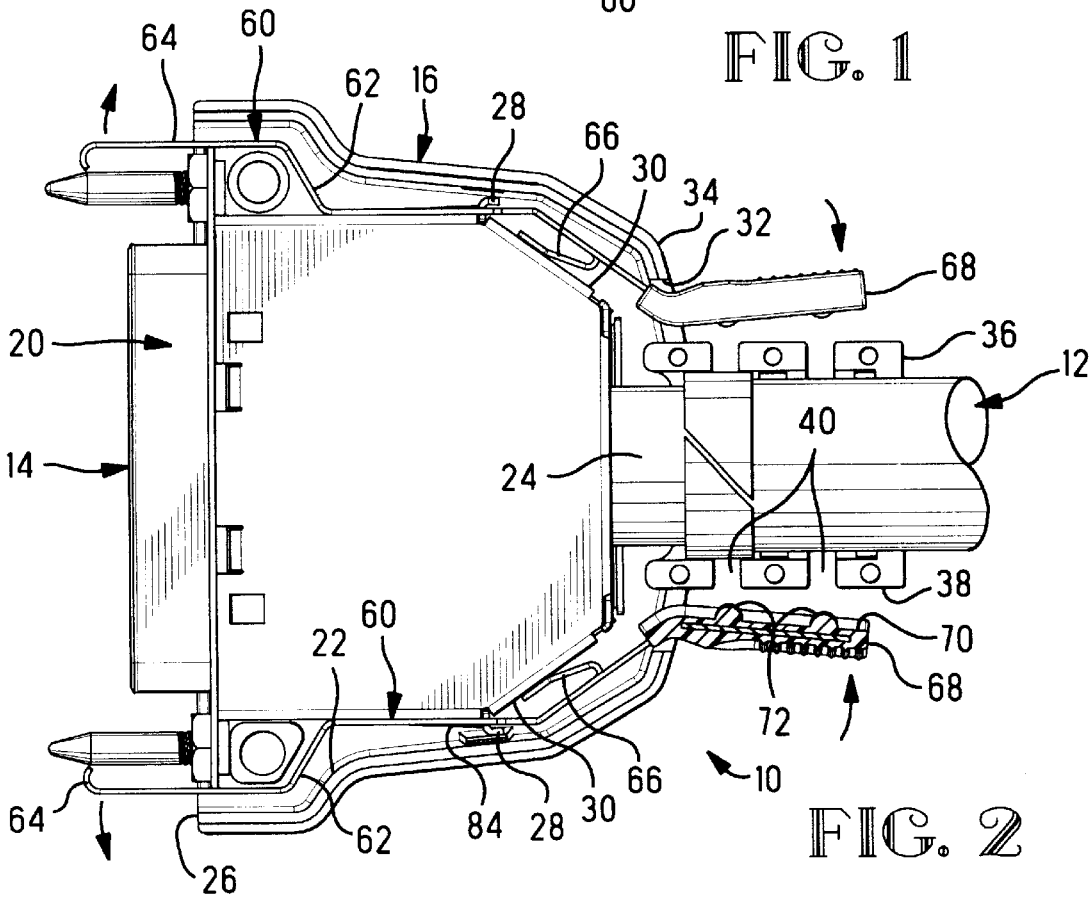
FIG. 2 is a plan view of the connector with the top cover removed, showing the latches thereof.
Figure 3:
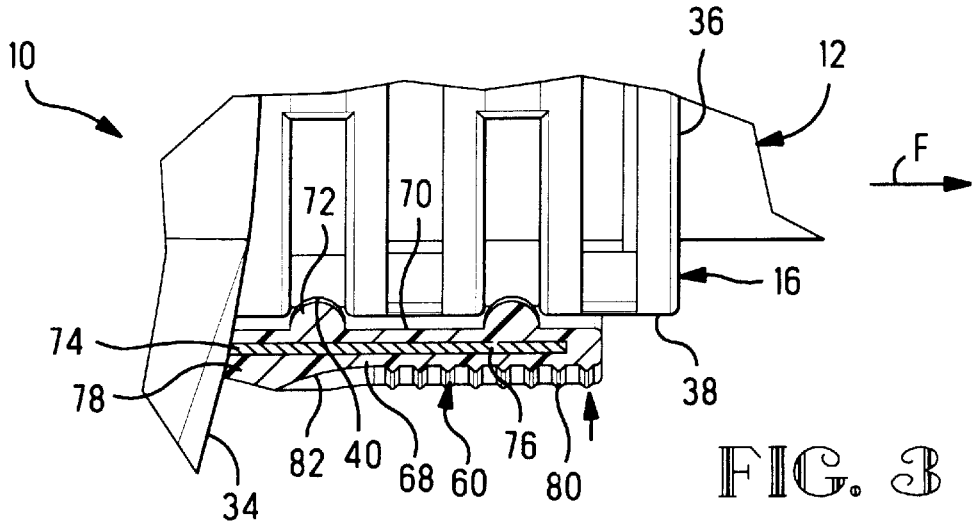
FIG. 3 is an enlarged partial section view of the rearward end of the connector illustrating one of the latches actuated during unlatching.

As can be seen in FIGS. 2 and 3, actuating sections 68 are spaced outwardly from outer surfaces 38 of strain relief portions 36 and are adapted to be deflected toward outer surfaces 38 upon actuation during delatching for unmating of the mated connectors.

In accordance with the present invention, outer surfaces 38 of strain relief portions 36 of covers 16 are profiled to define at least one recess 40 therealong. Each latching member 60 of the present invention includes an inwardly facing surface 70 that includes at least one protuberance 72 associated with recess 40 and adapted to enter recess 40 when actuating section 68 is manually urged against outer surface 38. With both latching members 60 in their actuated positions against outer surfaces 38 of strain relief portions 36 thus delatching the mated connectors, connector 10 may now be manually pulled for unmating the connectors in a manner that applies the pulling force F directly on the strain relief portions of the covers rather than stressing the retentive engagement of the covers 16 with the respective latch members, whereby longer in-service life with multiple mating/unmating cycles is provided for the connector 10 in an economical manner.

Figure 4:
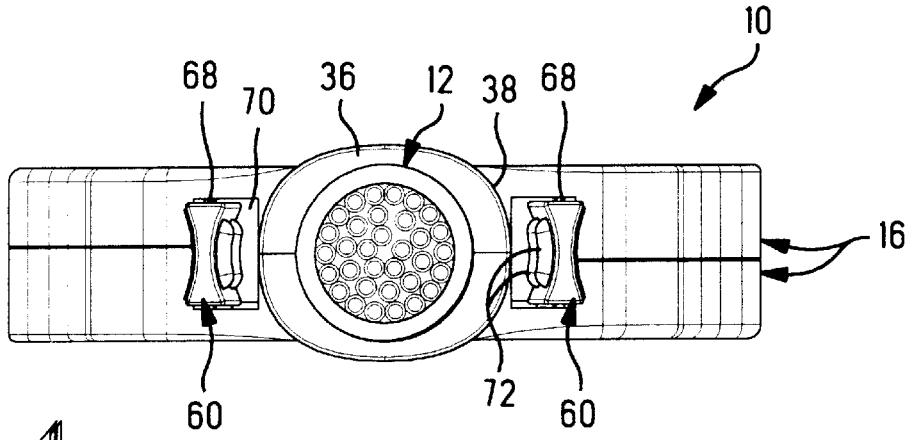
FIG. 4 is a rear plan view of the connector assembly, with the cable indicated in phantom.

Preferably, inwardly facing surface 70 of actuating section 68 of each latching member is shaped to conform to the cylindrical shape of the strain relief portions of the covers, and is therefor transversely concave. Protuberances 72 extend transversely across inwardly facing surface 70 and are seated in recesses 40 that extend circumferentially about outer surface 38 the strain relief portion for a substantial angular distance, as seen in FIG. 4. Each protuberance 72 may be concave to conform to complement a convex recess bottom surface upon actuation.

Figure 5:
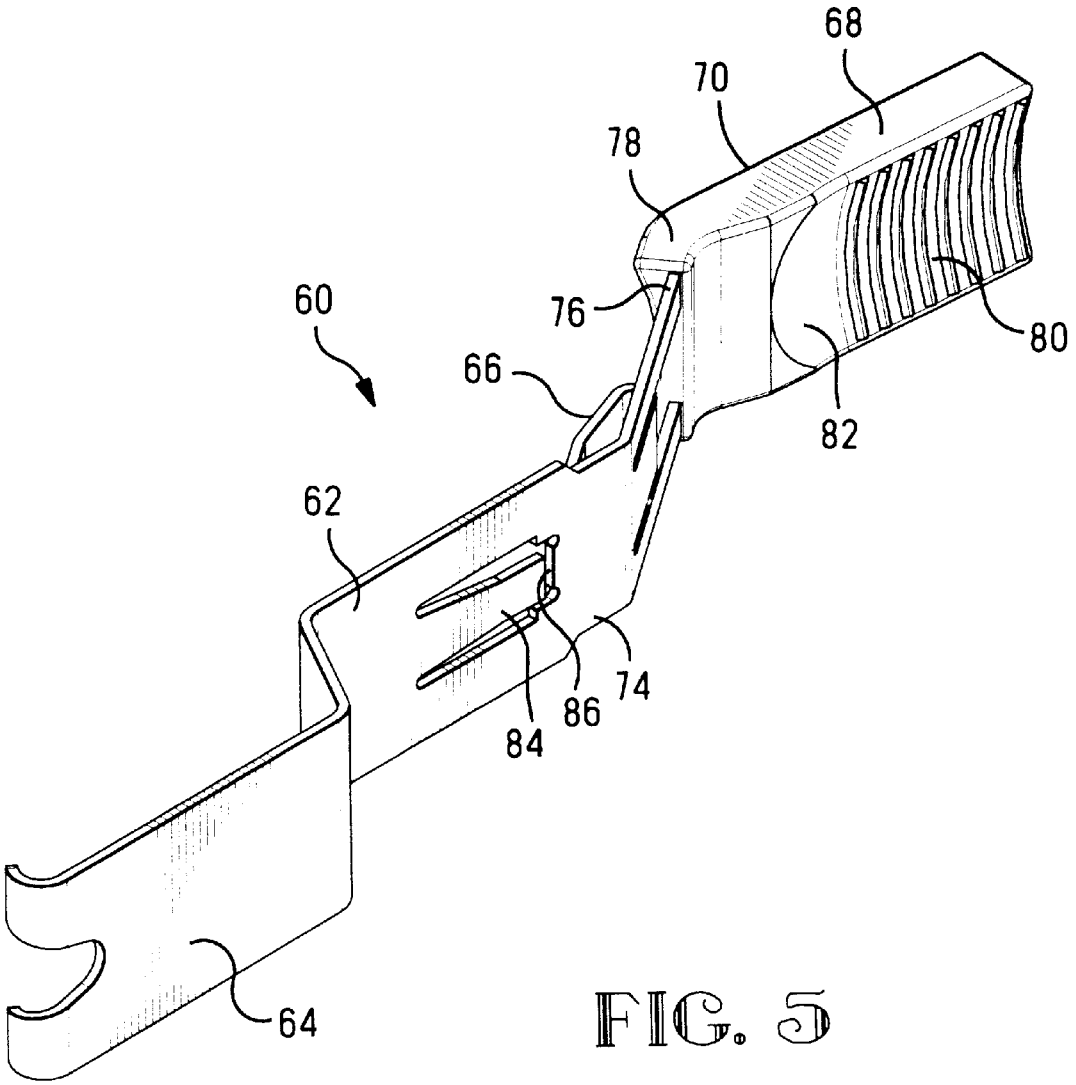
FIG. 5 is an isometric view of a latching arm of the present invention.

As seen in FIGS. 3 and 5, latching member 60 may be fabricated from a stamped and formed metal member 74 such as of stainless steel, and actuating section 68 may be defined by molding onto rear end 76 of metal member 74, a plastic cover 78 that will define one or more protuberances 72 along inner surface 70 and preferably a ribbed gripping section 80 along outwardly facing surface 82 to facilitate manual engagement and gripping thereof. Along body section 62 is formed a rearwardly extending lance 84 to engage tab 28 of connector subassembly 20 extending through a slot 86 at the rearward free end of lance 84, for retention of latching member 60 within the connector.

Figure 6:
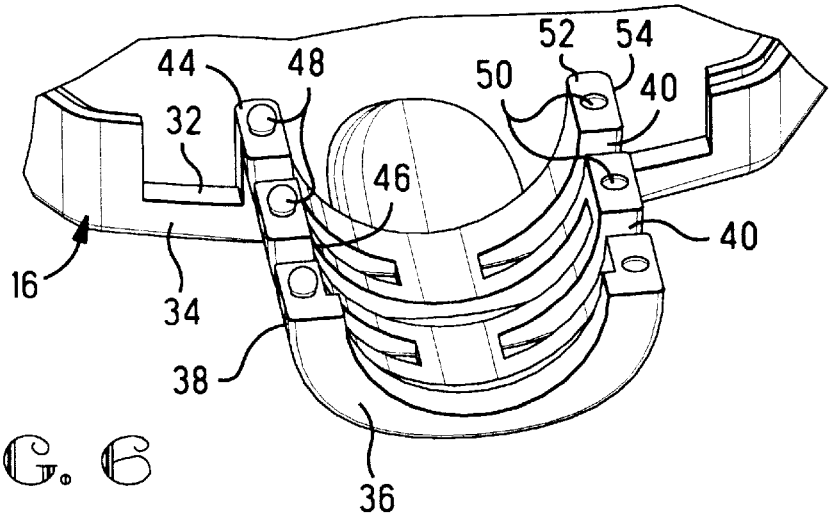
FIG. 6 is a partial isometric view of a cover of the connector of FIGS. 1 to 3.

As seen in FIG. 6, each cover 16 may be provided with a strain relief portion 36 that includes a surface 44 along one side 46 that includes an array of bosses 48 and a complementary array of boss-receiving holes 50 into surface 52 along the other side 54. Thus when the pair of covers are being secured about connector subassembly 20 with strain relief portions 36 along a portion of cable 12, surfaces 44 and 52 abut with bosses 48 snap-fitted into holes 50 securing the strain relief sections 36 to each other about the cable. The inside diameter of the strain relief sections is preferably slightly less than the outer diameter of the cable jacket, so that compression of the insulative cable jacket is achieved, with the strain relief sections also protecting against sharp bends of the cable at the cable exit.

A plurality of protuberances 72 and recesses 40 may be provided. Other variations and modifications may occur to the specific example disclosed herein, that are within the spirit of the invention and the scope of the claims.

What is claimed is:

1. An electrical connector comprising:

a connector subassembly having a front section having a mating face and a rear section having a rear face, an insulative cover over said connector subassembly extending from said mating face to said rear face, and said cover further having a cover rear section extending rearwardly beyond said rear face and along a cable exiting from said rear face, and a pair of latch members secured in respective channels of the cover and extending from said mating face, said pair of latch members having actuation sections protruding outwardly from said rear section rearwardly from said rear face to free ends alongside said cover rear section, said actuating sections adapted to be deflected toward and against said rear section of said cover upon actuation of said actuating sections, and cover-facing surfaces of said actuating sections including at least one protuberance extending toward facing surfaces of said cover rear section and to be received into corresponding recesses defined in said facing surfaces of said cover rear section upon full actuation of said actuating sections, whereby rearwardly directed force applied to the actuating sections for rearward movement of the connector is transmitted by the fully actuated actuating sections to said rear section of said cover to relieve stress on at least said latch members.

2. The connector as set forth in claim 1 wherein each said actuating section includes a plurality of said protuberances.

3. The connector as set forth in claim 1 wherein said actuating section includes a plastic cover molded to define said at least one protuberance.

4. The connector as set forth in claim 1 wherein each said at least one protuberance extends transversely across said cover-facing facing surface of said actuating section for an extended angular distance.

5. The connector as set forth in claim 4 wherein each said at least one protuberance is concave to conform to a convex recess bottom surface.

* * * * *